US005540480A

United States Patent [19]

Christa

[11] Patent Number: 5,540,480

[45] Date of Patent: Jul. 30, 1996

[54] VERSATILE SEAT SKIRT

[76] Inventor: Carol Christa, 830 Valley View La., Duluth, Ga. 30136

[21] Appl. No.: 320,967

[22] Filed: Oct. 12, 1994

[51] Int. Cl.[6] ..... A47C 31/00

[52] U.S. Cl. ..... 297/219.1; 297/DIG. 6; 297/218.2; 5/493; 5/923

[58] Field of Search ..... 297/219.1, DIG. 6, 297/218.1, 218.2; 5/486, 493, 907, 922, 923

[56] References Cited

U.S. PATENT DOCUMENTS

| | | | |
|---|---|---|---|
| 3,063,749 | 11/1962 | Struble et al. . | |
| 3,066,323 | 4/1962 | Kintner | 5/334 |
| 3,113,803 | 10/1963 | Struble et al. . | |
| 3,563,599 | 2/1971 | Heumann . | |
| 3,695,690 | 10/1972 | Carson | 297/219.1 |
| 3,695,691 | 10/1972 | Putnam | 297/223 |
| 5,205,003 | 4/1993 | Green | 5/493 |

FOREIGN PATENT DOCUMENTS

| | | | |
|---|---|---|---|
| 1404365 | 8/1975 | United Kingdom | 5/493 |

*Primary Examiner*—Peter R. Brown

*Attorney, Agent, or Firm*—Rhodes Coats & Bennett L.L.P.

[57] ABSTRACT

A seat assembly to permit the look of a seat to be easily changed includes a seat body including sides, upholstery covering at least a portion of the seat body, a strip of a hook-type hook-and-loop fastener secured to and extending circumferentially around the sides of the seat body, a ribbon of upholstery backed to a strip of loop-type hook-and-loop fastener, and a removable skirt element including a band of a width wider than the ribbon, the band having one side backed to a strip of loop-type hook-and-loop fastener. Loose pillows on the seat body have a covering on one side of a formal look and a covering on a reverse side of a casual look, whereby the ribbon of upholstery or the band of upholstery may be selectively mounted to the seat body by joining the hook-and-loop type fasteners to permit the look of the seat to be easily changed from a skirtless to a skirted look and the pillows may be displayed as desired to complement the skirted or skirtless look.

15 Claims, 1 Drawing Sheet

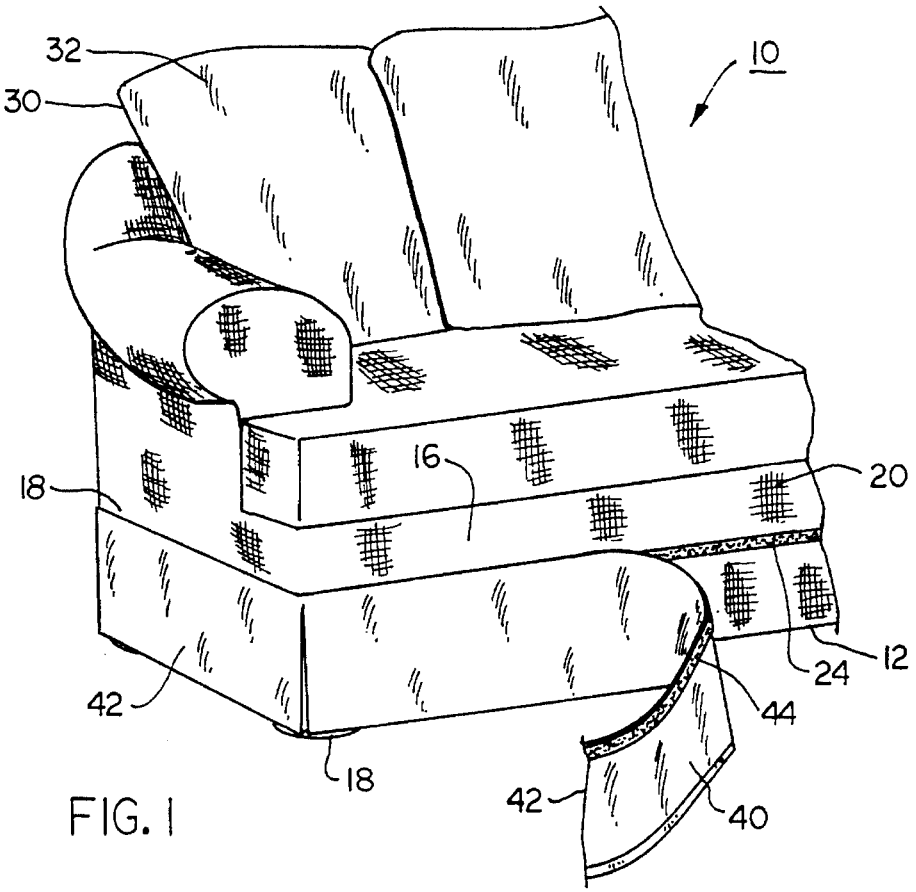
FIG. 1
FIG. 2
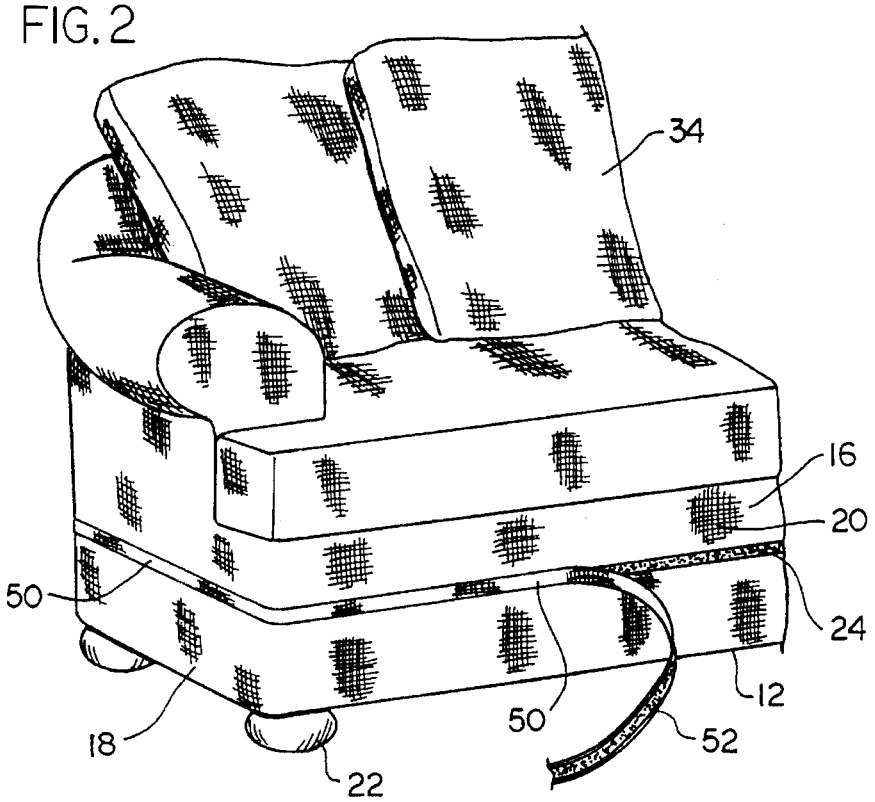

VERSATILE SEAT SKIRT

BACKGROUND OF THE INVENTION

The present invention relates to improvements in the design of upholstered furniture, to provide the manufacturer, retailer or consumer with the ability to easily vary the look of an upholstered seat as desired, at very low expense. Upholstered seats such as sofas, loveseats, and chairs, and also conversation pit or sectional seat modules are very well known in the furniture industry. It is well known to make these units in a variety of frame styles, and also to provide many possibilities of upholstery, including many grades and designs of cloth, and leather, vinyl or other materials. In most cases, the look of the furniture is established when the piece is made, with the upholstery made up to cover the frame in a substantially permanent fashion. Although re-upholstering of frames is known, such reupholstering is usually a major undertaking requiring hours of a skilled craftsperson's time.

Thus, it is usually beyond the ability of consumers to make changes of this type on their own. That is not to say that changes may not be desirable to the consumer. Many consumers encounter the situation that the same piece of furniture will be present in a room set for a casual get-together, and also for more formal occasions. Conventional upholstered furniture forces the consumer to accept compromises—a formally upholstered piece will always be formal, and a casual look will always be casual. Consumers would benefit from improvements to upholstered furniture to permit quick, easy, inexpensive changes of the look of an upholstered seat, to allow the seat to be customized for the occasion.

SUMMARY OF THE INVENTION

The present invention fulfills this need in the art by providing a seat assembly to permit the look of a seat to be easily changed. A seat body including a base and sides, and upholstery covers at least a portion of the seat body. A strip of a first hook-and-loop fastener type is secured to and extends laterally around at least two sides of the seat body. A ribbon of upholstery is backed to a strip of a second hook-and-loop fastener type, so that the ribbon of upholstery may be selectively mounted to the seat body by joining the hook-and-loop type fasteners to provide a skirtless look or removed from the seat body to permit the look of the seat to be easily changed.

In a preferred embodiment, the apparatus further includes a removable skirt element including a band of a width wider than the ribbon, the band having one side backed to a strip of the second hook-and-loop fastener type, so that the band of upholstery may be selectively mounted to the seat body by joining the hook-and-loop type fasteners to give the seat a skirted look or removed, as desired. Typically, the band will have a width and the second type of hook-and-loop fastener is located on the band so that when the second type of hook-and-loop fastener is affixed to the first type of hook-and-loop fastener on the seat body, the band substantially entirely hides the base, which often includes the furniture piece's feet or legs.

Preferably, the first hook and loop fastener type is hook type.

In a particularly preferred embodiment, the seat assembly includes loose pillows on the seat body, the loose pillows having a covering on one side of a formal look and a covering on a reverse side of a casual look, so that the pillows may be displayed as desired to complement the look achieved by mounting the ribbon or the skirt.

The band may have pleats and/or ruffles to give a look of a pleated and/or ruffled skirt.

The upholstery covering the seat body and the ribbon of upholstery may or may not be of the same surface appearance.

Preferably, the strip of first hook-and-loop fastener type extends all the way around the seat body.

The invention also provides a method of changing the look of a seat having a seat body and upholstered sides. The method includes the steps of affixing a ribbon of upholstery backed to a strip of a hook-and-loop fastener type to a strip of a hook-and-loop fastener type secured to and extending laterally around at least two sides of the seat body to provide a skirtless look, removing the ribbon, and affixing a band of upholstery backed to a strip of a hook-and-loop fastener type to the strip of hook-and-loop fastener secured to the seat body to provide a skirted look.

In another embodiment the method includes affixing a band of upholstery backed to a strip of a hook-and-loop fastener type to a strip of a hook-and-loop fastener type secured to and extending laterally around at least two sides of the seat body to provide a skirted look, removing the band, and affixing a ribbon of upholstery backed to a strip of a hook-and-loop fastener type to the strip of hook-and-loop fastener secured to the seat body to provide a skirtless look.

The method may include reversing loose pillows on the seat body to show a covering on one side of a formal look and a covering on a reverse side of a casual look, thereby displaying the pillows as desired to complement the skirted or skirtless look achieved by mounting the ribbon or band.

BRIEF DESCRIPTION OF THE DRAWINGS

The invention will be better understood after a reading of the Detailed Description of the Preferred Embodiments and a review of the drawings in which:

FIG. 1 is a view of a seat having a skirted look; and

FIG. 2 is a view of a seat having a skirtless look according to an embodiment of the invention.

DETAILED DESCRIPTION OF THE PREFERRED EMBODIMENTS

FIGS. 1 and 2 show an embodiment of the invention in the process of being changed from a casual, skirtless look to a more formal, skirted look. The more formal look is shown in FIG. 1. The seat 10 includes a seat frame of any design, such as a conventional designs or further designs that are come up with in the future. The frame can be for a single chair loveseat sofa, a sectional seat module, a chaise lounge, an ottoman, motion sofas, chairs, sectionals, and dining chairs or any other desired upholstered piece. The important aspect is that the upholstered piece is to rest on a floor and thereby is amenable to changes from a skirted to a skirtless look. The seat body 14 includes a front side 16 and a right side 18 as well as left side and rear sides, not shown. Desirably, the seat frame 12 is covered with upholstery 20, although the seat need not be entirely covered with upholstery, since some ornamental designs will have wood or other materials of the seat showing. "Upholstery" should be construed in this application to be given a broad scope including virtually any flexible material used to cover seats, including fabrics, leather, vinyl, Naugahyde, or any other seat covering.

Extending around the sides 16,18 of the seat body 14 is a strip of hook-type hook-and-loop material 24. The seat body 14 is supported by feet/legs 22.

As seen in FIG. 1, the seat 10 is given a skirted look by the application of a skirt element 40. The skirt element 40 includes a band 42 of upholstery, usually, although not always, of the same type as the upholstery 20. The band 42 has a width comparable to the height of the top of the strip 24 off of the floor. If desired, the band can have ruffles or pleats, as shown. The top edge of the skirt element 40 has a rear face to which is attached a strip of loop-type hook-and-loop fastener 44. It is preferred to put the loop-type material on the skirt element 40 and the hook-type on the seat, because the loop-type material is more flexible. This will allow the skirt to more closely conform to the shape dictated by the seat when the skirt is applied. The hook-and-loop fasteners 24,44 are well-known as being adaptable to make and break engagement between themselves, so that the skirt element 40 can be mounted to the seat body or removed, using the hook-and-loop fasteners.

The formal look of the seat 10 of FIG. 1 is further enhanced by the presence of loose pillows 30 having a formal cover 32. The formal cover 32 can be any desired pattern complementing the formal look of the skirt.

Referring now to FIG. 2, the more casual look of the seat 10 can be seen. In this embodiment, the skirt element 40 is removed from the seat entirely and stored away. In its place is mounted a ribbon 50 of upholstery, typically matching the upholstery 20. However, it could be a complementing or contrasting color, pattern or material, if desired. The ribbon 50 is backed by a strip 52 of loop-type hook-and-loop material, like the loop-type 44 on the back of the skirt element 40. Thus, the ribbon 50 can be secured in place or not, as desired, by affixing the strip of loop-type material 52 to the strip of hook-type material 24. The ribbon gives the look of a welting, usually a less formal look.

The casual look achieved in FIG. 2 is further enhanced by the presence of pillows having casual-look covers 34. The change in the covers from formal covers 32 to casual covers 34 can be accomplished in a number of ways. The pillows may be backed on one side with one pattern, and on the other side with an alternate pattern, so that merely reversing the position of the pillow changes the look. Alternately, the pillows 30 can be provided with slipcovers to allow the look to be changed by adding or removing a slipcover or, simply, a different set of pillows can be put on the seat 10.

Thus, the look of the seat can be changed from the formal look of FIG. 1 to the casual look of FIG. 2 quite rapidly and easily. The skirt element 40 may be removed by simply tugging on one end of the skirt element 40 and separating the fastener 44 from the strip 24 around the seat 10. Then, the ribbon 50 can be put in its place by pressing the loop-type backing strip 52 into place around the edge of the seat. In addition, the pillows can be changed in any of the ways mentioned above to achieve the more casual look.

When it is desired to return to a more formal look, the ribbon 50 can be pulled off and replaced with the skirt element 40, and the casual-look covers 34 of the pillows can be changed back to the formal covers 32.

This flexibility can be taken advantage of by a manufacturer, by a retailer, or by the consumer, depending on how the manufacturer and retailer choose to implement the invention. That is, the manufacturer can keep the seat 10 in stock and, in response to an order for more formal design, apply the skirt element 40 and the formal covers 32 on pillows 30 and ship the seat. If the order is for a more casual look, the ribbon 50 can be installed along with the casual-look covers 54.

Alternately, the manufacturer can assemble the seat and provide to its customer, the retailer, the skirt element 40 and the ribbon 50 to be put in place as desired by a consumer.

Most advantageously, however, the seat 10 can be sold to a consumer by providing the consumer with both the skirt element 40 and the ribbon 50 as well as, optionally, the choices of pillows 30. This gives the consumer the option of changing back and forth from the casual to the formal look as often as desired.

Those of ordinary skill in the art will appreciate that the invention can be carried out and various modifications to the specifics spelled out herein, and those modifications are deemed to be within the scope of the invention.

What is claimed is:

1. A seat assembly to permit the look of a seat to be easily changed comprising:

a seat body including a horizontal seat cushion and a base portion below said seat cushion having sides, upholstery covering at least a portion of said seat body, a first strip of a first hook-and-loop fastener type secured to and extending laterally around at least two sides of said base portion, a ribbon of upholstery backed to a second strip of a second hook-and-loop fastener type, said ribbon having a width substantially narrower than said base portion, and a skirt element including a band of a width wider than said ribbon said band having one side backed to a third strip of said second hook-and-loop fastener type, whereby said ribbon of upholstery or said skirt element may be selectively mounted to said at least two sides of said base portion by joining said first and second strips of said hook-and-loop type fasteners to provide a skirtless look or said first and third strips of said hook-and-loop type fasteners to provide a skirted look.

2. An apparatus as claimed in claim 1 wherein said first hook and loop fastener type is hook type.

3. An apparatus as claimed in claim 1 wherein said seat assembly includes loose pillows on said seat body, said loose pillows having a covering on one side of a formal look and a covering on a reverse side of a casual look, so that said pillows may be displayed as desired to complement the look achieved by mounting said ribbon or another look.

4. An apparatus as claimed in claim 1, wherein said band has a width and said third strip of said second type of hook-and-loop fastener is located on said band so that when said third strip of said second type of hook-and-loop fastener is affixed to said first strip of said first type of hook-and-loop fastener on said base portion, said band substantially entirely hides said base portion.

5. An apparatus as claimed in claim 1 wherein said band has pleats or ruffles to give a look of a pleated or ruffled skirt.

6. An apparatus as claimed in claim 1 wherein said upholstery covering said seat body and said ribbon of upholstery may or may not be of the same surface appearance.

7. An apparatus as claimed in claim 1 wherein said upholstery covering said seat body and said band of upholstery may or may not be of the same surface appearance.

8. An apparatus as claimed in claim 1 wherein said first strip of said first hook-and-loop fastener type extends all the way around said base portion.

9. An apparatus as claimed in claim 1 further comprising a second ribbon of upholstery backed to a fourth strip of said second hook-and-loop fastener type, so that said ribbons may be selectively mounted to said base portion by joining said fourth strip of said second hook-and-loop type fastener to said first strip of said first hook-and-loop fastener type secured to said base portion.

10. An apparatus as claimed in claim 1 further comprising a second ribbon of upholstery backed to a fourth strip of said hook-and-loop fastener type, so that said ribbons and skirt may be selectively mounted to said base portion by joining said second, third or fourth strip of said second hook-and-loop type fastener to said first strip of said first hook-and-loop fastener type secured to said base portion.

11. An apparatus as claimed in claim 1 further comprising a second skirt of upholstery backed to a fourth strip of said second hook-and-loop fastener type, so that said skirts may be selectively mounted to said base portion by joining said third or fourth strip of said second hook-and-loop type fastener to said first strip of said first hook-and-loop fastener type secured to said base portion.

12. A seat assembly to permit the look of a seat to be easily changed comprising:

a seat body including a horizontal seat cushion and a base portion below said seat cushion having sides, upholstery covering at least a portion of said seat body, a first strip of a hook-type hook-and-loop fastener secured to and extending circumferentially around at least two sides of said base portion, a ribbon of upholstery backed to a second strip of loop-type hook-and-loop fastener, said ribbon having a width substantially narrower than said base portion, a removable skirt element including a band of upholstery of a width wider than said ribbon, said band having one side backed to a third strip of said loop-type hook-and-loop fastener, said band having a width and said third strip of said loop-type hook-and-loop fastener is located on said band so that when said second strip or said third strip of said loop-type hook-and-loop fastener is affixed to said at least two sides of said base portion with said first strip of said hook-type hook-and-loop fastener on said base portion, said band substantially entirely hides said base portion, and loose pillows on said seat body, said loose pillows having a covering on one side of a formal look and a covering on a reverse side of a casual look, whereby said ribbon of upholstery or said band of upholstery may be selectively mounted to said sides of said base portion by joining first strip of said hook-type hook-and-loop fastener and said second or third strip of said loop-type hook-and-loop fastener to permit the look of the seat to be easily changed from a skirtless to a skirted look and said pillows may be displayed as desired to complement said skirted or skirtless look.

13. A method of changing the look of a seat comprising:

providing a seat body having a horizontal seat cushion, a base portion below the seat cushion having upholstered sides, and a first strip of a first hook-and-loop fastener type secured to and extending laterally around at least two sides of the base portion, affixing a ribbon of upholstery substantially narrower than the base portion and backed to a second strip of a second hook-and-loop fastener type to the at least two sides of the base portion with the first strip of the first hook-and-loop fastener type secured to the base portion to provide a skirtless look, removing the ribbon, and affixing a band of upholstery having a width wider than the ribbon and backed to a third strip of the second hook-and-loop fastener type to the first strip of the first hook-and-loop fastener type secured to the base portion to provide a skirted look.

14. A method as claimed in claim 11 further comprising reversing loose pillows on the seat body to show a covering on one side of a formal look and a covering on a reverse side of a casual look, displaying the pillows as desired to complement the skirted or skirtless look achieved by mounting the ribbon or band.

15. A method of changing the look of a seat comprising:

providing a seat body having a horizontal seat cushion, a base portion below the seat cushion having upholstered sides, and a first strip of a first hook-and-loop fastener type secured to and extending laterally around at least two sides of the base portion, affixing a band of upholstery backed to a second strip of a second hook-and-loop fastener type to at least two sides of the base portion with the first strip of the first hook-and-loop fastener type secured to the base portion to provide a skirted look, removing the band, and affixing a ribbon of upholstery substantially narrower than the base portion and the band and backed to a third strip of the second hook-and-loop fastener type to the first strip of the first hook-and-loop fastener type secured to the base portion from which the band was removed to provide a skirtless look.

* * * * *